US012662889B2

(12) United States Patent
Tardy et al.

(10) Patent No.: US 12,662,889 B2
(45) Date of Patent: Jun. 23, 2026

(54) SYSTEMS AND METHODS FOR ESTIMATING THE POSITION OF SOLID FILLS AND OPTIMIZING THEIR REMOVAL DURING COILED TUBING CLEANOUT OPERATIONS

(71) Applicant: Schlumberger Technology Corporation, Sugar Land, TX (US)

(72) Inventors: Philippe Michel Jacques Tardy, Sugar Land, TX (US); Pavel Spesivtsev, Houston, TX (US); Pierre Ramondenc, Petaling Jaya (FR); Tianxiang Su, Cambridge, MA (US); Dongkeun Lee, Sugar Land, TX (US); Jordi Juan Segura Dominguez, Beijing (CN); Laurence Fossati, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/134,716

(22) PCT Filed: Nov. 29, 2023

(86) PCT No.: PCT/US2023/081511

§ 371 (c)(1),
(2) Date: May 31, 2025

(87) PCT Pub. No.: WO2024/118706

PCT Pub. Date: Jun. 6, 2024

(65) Prior Publication Data

US 2026/0009300 A1 Jan. 8, 2026

Related U.S. Application Data

(60) Provisional application No. 63/385,687, filed on Dec. 1, 2022.

(51) Int. Cl.

| | |
|---|---|
| ***E21B 21/08*** | (2006.01) |
| ***E21B 37/00*** | (2006.01) |
| ***E21B 47/04*** | (2012.01) |

(52) U.S. Cl.
CPC ..... *E21B 21/08* (2013.01); *E21B 37/00* (2013.01); *E21B 47/04* (2013.01); *E21B 2200/20* (2020.05)

(58) Field of Classification Search
CPC ..... E21B 21/08; E21B 37/00; E21B 47/04; E21B 2200/20
See application file for complete search history.

(56) References Cited

U.S. PATENT DOCUMENTS 6,982,008 B2 1/2006 Walker
10,100,614 B2 * 10/2018 Forstner ..... E21B 37/00
(Continued)

FOREIGN PATENT DOCUMENTS

WO 2024035758 A1 2/2024
WO 2024118706 A1 6/2024
(Continued)

OTHER PUBLICATIONS

SLB oilfield Glossary, Published Dec. 2, 2024, https://glossary.slb.com/terms/c/cuttings.*
(Continued)

*Primary Examiner* — Nicole Coy
*Assistant Examiner* — Nicholas D Wlodarski
(74) *Attorney, Agent, or Firm* — Jeffrey D. Frantz

(57) ABSTRACT

Systems and methods presented herein facilitate coiled tubing operations, and generally relate to generating a depth of solids origin (DSO) guess that represents a depth location of solids in a wellbore traversing a hydrocarbon-bearing formation, using a calibrated flow model (FM) to predict an amount of solids at a surface location of the wellbore based
(Continued)

at least in part on the DSO guess, comparing the predicted amount of the solids at the surface location of the wellbore to a measured amount of solids at the surface location of the wellbore, determining that the DSO guess is equal to an actual DSO within the wellbore when the predicted amount of the solids at the surface location of the wellbore matches the measured amount of solids at the surface location of the wellbore, and adjusting one or more operational parameters of a coiled tubing system to reduce an amount of the solids at the DSO within the wellbore.

24 Claims, 10 Drawing Sheets

(56) References Cited

U.S. PATENT DOCUMENTS

| | | | | |
|---|---|---|---|---|
| 11,619,124 | B2 | 4/2023 | Morrison | |
| 11,808,097 | B2 | 11/2023 | Morrison | |
| 12,000,261 | B2 | 6/2024 | Liu | |
| 12,312,937 | B2 * | 5/2025 | Safonov | E21B 47/002 |
| 2008/0066962 | A1 | 3/2008 | Rolovic | |
| 2010/0170676 | A1 | 7/2010 | Misselbrook | |
| 2012/0255727 | A1 | 10/2012 | Cameron | |
| 2015/0293252 | A1 | 10/2015 | Miller | |
| 2020/0332654 | A1 | 10/2020 | Rowe | |
| 2022/0251950 | A1 * | 8/2022 | Al-Malki | E21B 49/005 |
| 2023/0383646 | A1 | 11/2023 | Yip | |
| 2024/0287859 | A1 | 8/2024 | Dvorak | |
| 2024/0287860 | A1 | 8/2024 | Su | |
| 2024/0287883 | A1 | 8/2024 | Tardy | |
| 2024/0426183 | A1 | 12/2024 | Zheng | |
| 2024/0426204 | A1 | 12/2024 | Segura | |
| 2025/0027402 | A1 | 1/2025 | Abuhaikal | |
| 2025/0084754 | A1 | 3/2025 | Hassig Fonseca | |
| 2025/0084758 | A1 | 3/2025 | Tardy | |

FOREIGN PATENT DOCUMENTS

| | | | |
|---|---|---|---|
| WO | 2024151569 | A1 | 7/2024 |
| WO | 2024229316 | A1 | 11/2024 |
| WO | 2025096987 | A1 | 5/2025 |
| WO | 2025122527 | A1 | 6/2025 |

OTHER PUBLICATIONS

International Search Report and Written Opinion of International Patent Application No. PCT/US2023/081511 dated on Mar. 21, 2024, 08 pages.

Tardy, P. et al., "Multivariate Sensitivity Analysis and Real-Time Algorithms in Data-Driven Coiled Tubing Cleanouts Turn Insights into Action", IPTC-23959-MS, presented at the International Petroleum Technology Conference, Dhahran, Saudi Arabia, 2024, 15 pages.

* cited by examiner

SYSTEMS AND METHODS FOR ESTIMATING THE POSITION OF SOLID FILLS AND OPTIMIZING THEIR REMOVAL DURING COILED TUBING CLEANOUT OPERATIONS

CROSS-REFERENCE TO RELATED APPLICATION

This application is a National Phase Entry of International Application No. PCT/US2023/081511, filed Nov. 29, 2023, which claims priority to and the benefit of U.S. Provisional Patent Application No. 63/385,687, entitled "SYSTEMS AND METHODS FOR ESTIMATING THE POSITION OF SOLID FILLS AND OPTIMIZING THEIR REMOVAL DURING COILED TUBING CLEANOUT OPERATIONS," filed Dec. 1, 2022, which is hereby incorporated by reference in its entirety for all purposes.

BACKGROUND

The present disclosure generally relates to systems and methods for automatically improving performance of coiled tubing operations in substantially real time.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In many well applications, coiled tubing is employed to facilitate performance of many types of downhole operations. Coiled tubing offers versatile technology due in part to its ability to pass through completion tubulars while conveying a wide array of tools downhole. A coiled tubing system may comprise many systems and components, including a coiled tubing reel, an injector head, a gooseneck, lifting equipment (e.g., a mast or a crane), and other supporting equipment such as pumps, treating irons, or other components. Coiled tubing has been utilized for performing well treatment and/or well intervention operations in existing wellbores such as hydraulic fracturing operations, matrix acidizing operations, milling operations, perforating operations, coiled tubing drilling operations, and various other types of operations.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include systems and methods for reducing an amount of solids in a wellbore by, for example, generating a depth of solids origin (DSO) guess that represents a depth location of solids in the wellbore traversing a hydrocarbon-bearing formation, using a calibrated flow model (FM) to predict an amount of solids at a surface location of the wellbore based at least in part on the DSO guess, comparing the predicted amount of the solids at the surface location of the wellbore to a measured amount of solids at the surface location of the wellbore, determining that the DSO guess is equal to an actual DSO within the wellbore when the predicted amount of the solids at the surface location of the wellbore matches the measured amount of solids at the surface location of the wellbore, and adjusting one or more operational parameters of a coiled tubing system to reduce an amount of the solids at the DSO within the wellbore.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
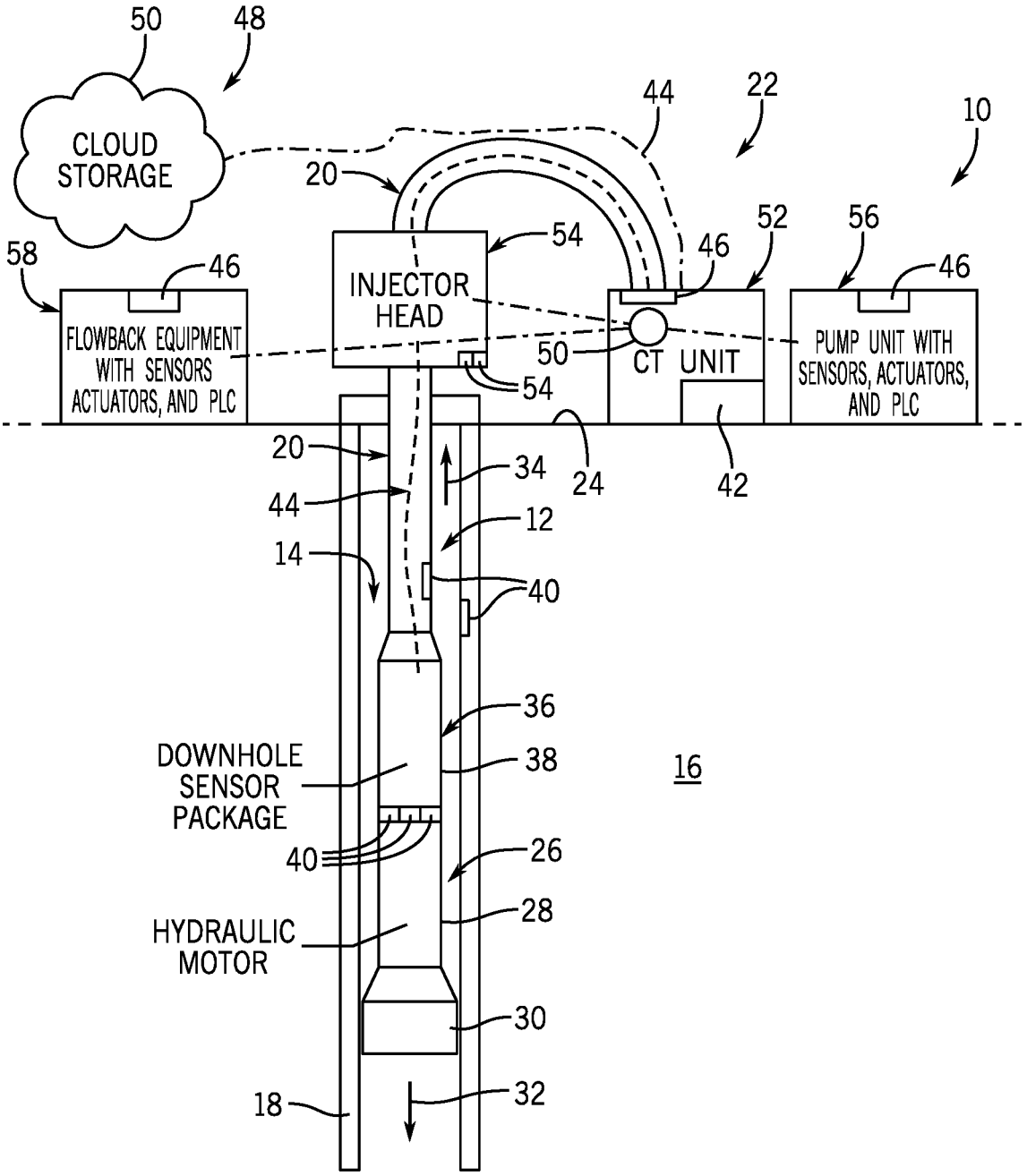
FIG. 1 illustrates a schematic diagram of an example coiled tubing system, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

As used herein, a fracture shall be understood as one or more cracks or surfaces of breakage within rock. Fractures can enhance permeability of rocks greatly by connecting pores together and, for that reason, fractures can be induced mechanically in some reservoirs in order to boost hydrocarbon flow. Certain fractures may also be referred to as natural fractures to distinguish them from fractures induced as part of a reservoir stimulation. Fractures can also be grouped into fracture clusters (or "perf clusters") where the fractures of a given fracture cluster (perf cluster) connect to the wellbore through a single perforated zone. As used herein, the term "fracturing" refers to the process and methods of breaking down a geological formation and creating a fracture (i.e., the rock formation around a well bore) by pumping fluid at relatively high pressures (e.g., pressure above the determined closure pressure of the formation) in order to increase production rates from a hydrocarbon reservoir.

In addition, as used herein, the terms "real time", "real-time", or "substantially real time" may be used interchangeably and are intended to described operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed are caused to be performed, for example, by a processing system (i.e., solely by the processing system, without human intervention).

During the life of an oil or gas production well, solid particles such as sand produced from unconsolidated formations or proppant left in the wellbore after an earlier fracturing job may settle at various depths along the wellbore. In some cases, they may accumulate into solid fills or form deep solid beds over significant distances in the wellbore. Cleanout Operations with Coiled Tubing (CTCO) consist in flushing these solid particles to surface by injecting fluids through the end of coiled tubing, next to where the solids lay in the wellbore. By supplying enough flow, the particles may remain suspended in the injected fluids and transported to surface.

To design a cleanout job, engineers often use computer programs that can simulate all the relevant physical phenomena occurring during such operations. Using such simulators, engineers investigate options such as pump rates, fluids to be pumped, coiled tubing movements that may provide the optimum CTCO, and so forth.

In many situations, some input parameters required by the simulators are not known with sufficient accuracy for the simulator's predictions to be reliable. For instance, the initial position and size of the solid fills in the wellbore is typically not known accurately prior to running the coiled tubing into hole. In this case, defining a CTCO design may be very challenging.

The embodiments described herein improve the performance of CTCO by combining, in substantially real time, the use of a simulator, or Flow Model (FM), and operational field measurements acquired by various sensors, to estimate the initial position of the solid beds and track their displacement during the CTCO execution. When the solids' initial bed position is known, the CTCO operator may optimize the CTCO performance in substantially real time by deciding upon the next CTCO actions to be taken to optimize solids removal at this estimated initial depth.

In particular, the embodiments described herein combine:

- a Flow Model (FM) as a computer program used to generate, in substantially real time, flow-related data that can or cannot be measured and that can be used to simulate the movement of solids particles along the wellbore during the CTCO;
- real-time measurement of the amount of solid particles being produced at the surface during the CTCO, acquired using physical sensors located downstream to the wellhead, or the real-time measurement of parameters that provide evidence of the presence of solids in the wellbore (e.g., a sudden drop in coiled tubing weight due to the coiled tubing hitting the obstruction caused by the solid fills;
- real-time measurement of dynamic inputs (DIs), which may be used by the FM to perform predictions and are acquired by relevant sensors, and which may include, but are not limited to:
  - pump rates for all injected fluids;
  - nature of injected fluid;
  - coil position along the wellbore; and
  - well-head pressure;

real-time measurement of the dynamic output (DOs), which can be predicted by the FM but that are not required to run the FM and are acquired by relevant sensors, and which may include, but are not limited to:
- flow rate of each fluid (e.g., oil, gas, water) being produced at the surface;
- pressure measurements at certain depths along wellbore;
- temperature measurements at certain depths along wellbore; and
- flow rate measurements at certain depths along wellbore; and an acquisition and communication system that transmits all the above sensor measurements to FM.
- to perform a continuous real-time calibration of FM, so that: (1) its accuracy improves with time, (2) it may be used to predict the outcome of potential future CTCO actions to be taken by the operator, and (3) it may be used to interpret past/present events that need to be analyzed during the CTCO, among other things.

In certain embodiments, the calibration may be performed by comparing, in substantially real time, the measured and simulated DOs and adjusting the value of some uncertain parameters, to obtain a match. As part of the process, some initially uncertain parameters are uncovered, which in turn may generate a re-calibration/re-computation of the entire operation to narrow down the operational envelope of the remainder of the operation.

With the foregoing in mind, FIG. 1 illustrates a schematic diagram of an example coiled tubing system 10. As illustrated, in certain embodiments, a coiled tubing string 12 may be run into a wellbore 14 that traverses a hydrocarbon-bearing formation 16 (i.e., reservoir). While certain elements of the coiled tubing system 10 are illustrated in FIG. 1, other elements of the coiled tubing system 10 (e.g., blow-out preventers, wellhead "tree", etc.) may be omitted for clarity of illustration. In certain embodiments, the coiled tubing system 10 includes an interconnection of pipes, including vertical and/or horizontal casings 18, coiled tubing 20, and so forth, that connect to a surface facility 22 at the surface 24 of the coiled tubing system 10. In certain embodiments, the coiled tubing 20 extends inside the casing 18 and terminates at a tubing head (not shown) at or near the surface 24. In addition, in certain embodiments, the casing 18 contacts the wellbore 14 and terminates at a casing head (not shown) at or near the surface 24.

In certain embodiments, a bottom hole assembly ("BHA") 26 may be run inside the casing 18 by the coiled tubing 20. As illustrated in FIG. 1, in certain embodiments, the BHA 26 may include a downhole motor 28 that operates to rotate a drill bit 30 (e.g., during drilling operations) or other downhole tools. In certain embodiments, the downhole motor 28 may be driven by hydraulic forces carried in fluid supplied from the surface 24 of the coiled tubing system 10. In certain embodiments, the BHA 26 may be connected to the coiled tubing 20, which is used to run the BHA 26 to a desired location within the wellbore 14. It is also contemplated that, in certain embodiments, the rotary motion of the drill bit 30 may be driven by rotation of the coiled tubing 20 effectuated by a rotary table or other surface-located rotary actuator. In such embodiments, the downhole motor 28 may be omitted.

In certain embodiments, the coiled tubing 20 may also be used to deliver fluid 32 to the drill bit 30 through an interior of the coiled tubing 20 to aid in the drilling process and carry cuttings and possibly other fluid or solid components in return fluid 34 that flows up the annulus between the coiled tubing 20 and the casing 18 (or via a return flow path provided by the coiled tubing 20, in certain embodiments) for return to the surface facility 22. It is also contemplated that the return fluid 34 may include remnant proppant (e.g., sand) or possibly rock fragments that result from a hydraulic fracturing application, and flow within the coiled tubing system 10. Under certain conditions, fracturing fluid and possibly hydrocarbons (oil and/or gas), proppants and possibly rock fragments may flow from the fractured formation 16 through perforations in a newly opened interval and back to the surface 24 of the coiled tubing system 10 as part of the return fluid 34. In certain embodiments, the BHA 26 may be supplemented behind the rotary drill by an isolation device such as, for example, an inflatable packer that may be activated to isolate the zone below or above it and enable local pressure tests.

As such, in certain embodiments, the coiled tubing system 10 may include a downhole well tool 36 that is moved along the wellbore 14 via the coiled tubing 20. In certain embodiments, the downhole well tool 36 may include a variety of drilling/cutting tools coupled with the coiled tubing 20 to provide a coiled tubing string 12. In the illustrated embodiment, the downhole well tool 36 includes the drill bit 30, which may be powered by the downhole motor 28 (e.g., a positive displacement motor (PDM), or other hydraulic motor) of the BHA 26. In certain embodiments, the wellbore 14 may be an open wellbore or a cased wellbore defined by the casing 18. In addition, in certain embodiments, the wellbore 14 may be vertical or horizontal or inclined. It should be noted the downhole well tool 36 may be part of various types of BHAs 26 coupled to the coiled tubing 20.

As also illustrated in FIG. 1, in certain embodiments, the coiled tubing system 10 may include a downhole sensor package 38 having multiple downhole sensors 40. In certain embodiments, the sensor package 38 may be mounted along the coiled tubing string 12, although certain downhole sensors 40 may be positioned at other downhole locations in other embodiments. In addition, in certain embodiments, downhole sensors 40 disposed on the coiled tubing 20 may be configured to detect downhole flow rates, downhole temperatures, and downhole pressures, and so forth, in the wellbore 14. In addition, in certain embodiments, downhole sensors 40 disposed on the casing 18 may be configured to detect downhole temperatures, and downhole pressures, and so forth, in the wellbore 14.

In certain embodiments, data from the downhole sensors 40 may be relayed uphole to a surface processing system 42 (e.g., a computer-based processing system) disposed at the surface 24 and/or other suitable location of the coiled tubing system 10. In certain embodiments, the data may be relayed uphole in substantially real time (e.g., relayed while it is detected by the downhole sensors 40 during operation of the downhole well tool 36) via a wired or wireless telemetric control line 44, and this real-time data may be referred to as edge data. In certain embodiments, the telemetric control line 44 may be in the form of an electrical line, fiber-optic line, or other suitable control line for transmitting data signals. In certain embodiments, the telemetric control line 44 may be routed along an interior of the coiled tubing 20, within a wall of the coiled tubing 20, or along an exterior of the coiled tubing 20. In addition, as described in greater detail herein, additional data (e.g., surface data) may be supplied by surface sensors 46 and/or stored in a memory location 48. By way of example, historical data and other useful data may be stored in the memory location 48 such as a cloud storage 50.

As illustrated, in certain embodiments, the coiled tubing 20 may be deployed by a coiled tubing unit 52 and delivered downhole via an injector head 54. In certain embodiments, the injector head 54 may be controlled to slack off or pick up the coiled tubing 20 so as to control the tubing string weight and, thus, the weight on bit (WOB) acting on the drill bit 30 (or the downhole well tool 36). In certain embodiments, the downhole well tool 36 may be moved along the wellbore 14 via the coiled tubing 20 under control of the injector head 54 so as to apply a desired tubing weight and, thus, to achieve a desired rate of penetration (ROP) as the drill bit 30 is operated. Depending on the specifics of a given application, various types of data may be collected downhole, and transmitted to the surface processing system 42 in substantially real time to facilitate improved operation of the downhole well tool 36. For example, the data may be used to fully or partially automate downhole operations, to optimize the downhole operations, and/or to provide more accurate predictions regarding components or aspects of the downhole operations.

In certain embodiments, fluid 32 may be delivered downhole under pressure from a pump unit 56. In certain embodiments, the fluid 32 may be delivered by the pump unit 56 through the downhole hydraulic motor 28 to power the downhole hydraulic motor 28 and, thus, the drill bit 30. In certain embodiments, the return fluid 34 is returned uphole, and this flow back of the return fluid 34 is controlled by suitable flowback equipment 58. In certain embodiments, the flowback equipment 58 may include chokes and other components/equipment used to control flow back of the return fluid 34 in a variety of applications, including well treatment applications.

As described in greater detail herein, the coiled tubing unit 52, the injector head 54, the pump unit 56, and the flowback equipment 58 may include advanced surface sensors 46, actuators, and local controllers, such as PLCs, which may cooperate together to provide sensor data to, receive control signals from, and generate local control signals based on communications with, respectively, the surface processing system 42. In certain embodiments, as described in greater detail herein, the surface sensors 46 may include flow rate, pressure, and fluid rheology sensors 46, among other types of sensors. In addition, as described in greater detail herein, the actuators may include actuators for pump and choke control of the pump unit 56 and the flowback equipment 58, respectively, among other types of actuators.

In certain embodiments, surface sensors 46 of the coiled tubing unit 52 may be configured to detect positions of the coiled tubing 20, weights of the coiled tubing 20, and so forth. In addition, in certain embodiments, surface sensors 46 of the injector head 54 may be configured to detect wellhead pressure, and so forth. In addition, in certain embodiments, surface sensors 46 of the pump unit 56 may be configured to detect pump pressures, pump flow rates, and so forth. In addition, in certain embodiments, surface sensors 46 of the flowback equipment 58 may be configured to detect fluids production rates, solids production rates, and so forth.

The embodiments described herein utilize a calibrated FM to determine the wellbore depth at which the solids, seen in the production fluids at the surface or detected by other means, originated initially. Once determined, a CTCO operator may consider bringing the coiled tubing 20 to the estimated depth of the solids origin (DSO) and using the calibrated FM to investigate options to ensure that either no particles are left at that DSO or that the amount that can be cleaned generates the maximum return of investment while keeping operation safe.

Figure 2:
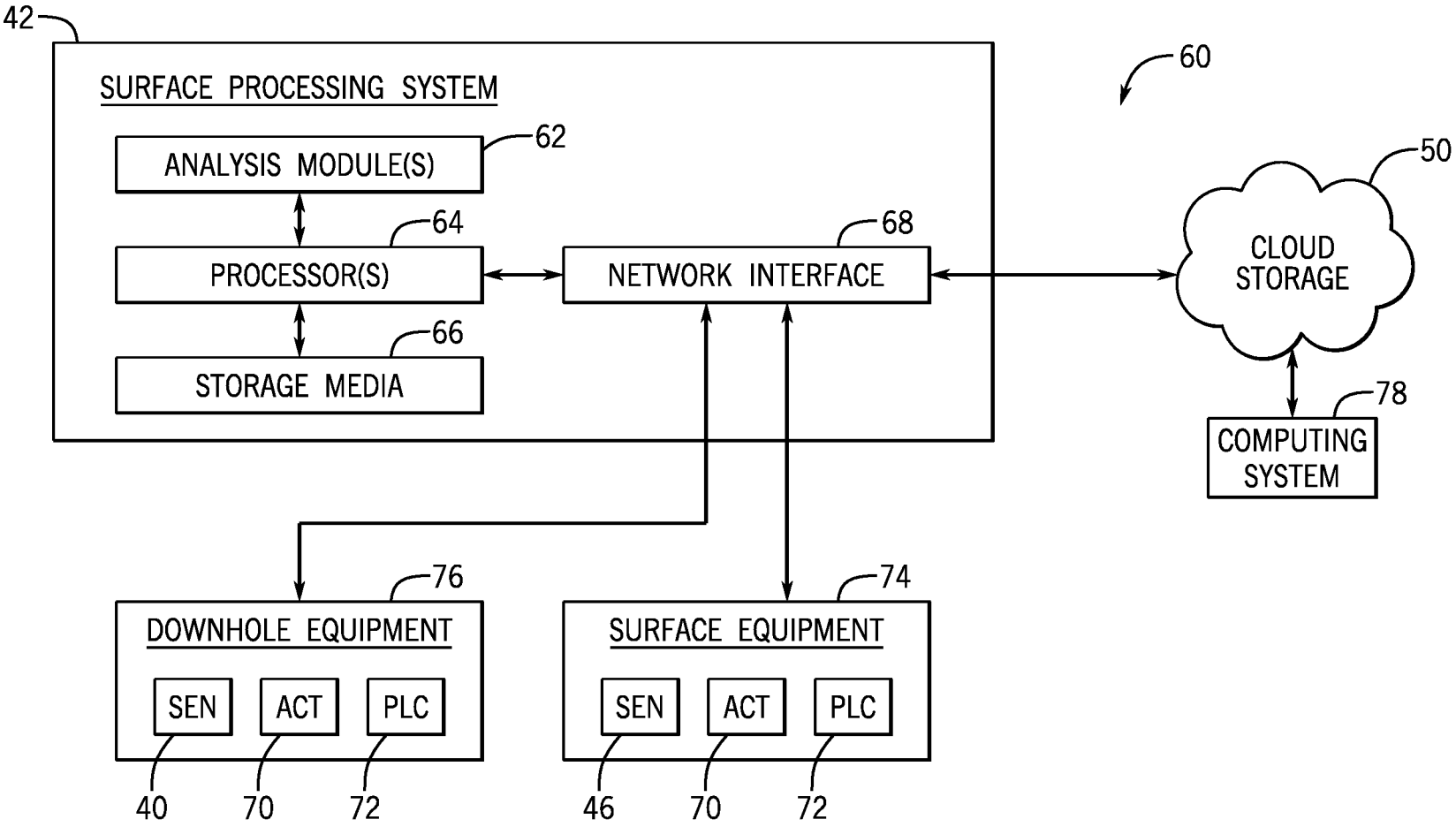
FIG. 2 illustrates a well control system including a surface processing system to control the coiled tubing system of FIG. 1, in accordance with embodiments of the present disclosure.

FIG. 2 illustrates a well control system 60 that may include the surface processing system 42 to control the coiled tubing system 10 described herein. In certain embodiments, the surface processing system 42 may include one or more analysis modules 62 (e.g., a program of computer-executable instructions and associated data) that may be configured to perform various functions of the embodiments described herein. In certain embodiments, to perform these various functions, the one or more analysis modules 62 may execute on one or more processors 64 of the surface processing system 42, which may be connected to one or more storage media 66 of the surface processing system 42. Indeed, in certain embodiments, the one or more analysis modules 62 may be stored in the one or more storage media 66.

In certain embodiments, the computer-executable instructions of the one or more analysis modules 62, when executed by the one or more processors 64, may cause the one or more processors 64 to generate one or more models (e.g., including the FM described in greater detail herein). Such models may be used by the surface processing system 42 to predict values of operational parameters that may or may not be measured (e.g., using gauges, sensors) during well operations.

In certain embodiments, the one or more processors 64 may include a microprocessor, a microcontroller, a processor module or subsystem, a programmable integrated circuit, a programmable gate array, a digital signal processor (DSP), or another control or computing device. In certain embodiments, the one or more processors 64 may include machine learning and/or artificial intelligence (AI) based processors. In certain embodiments, the one or more storage media 66 may be implemented as one or more non-transitory computer-readable or machine-readable storage media. In certain embodiments, the one or more storage media 66 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 62 may be provided on one computer-readable or machine-readable storage medium of the storage media 66, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 66 may be located either in the machine running the machine-readable instructions, or may be located at a remote site from which machine-readable instructions may be downloaded over a network for execution.

In certain embodiments, the processor(s) 64 may be connected to a network interface 68 of the surface processing system 42 to allow the surface processing system 42 to communicate with the multiple downhole sensors 40 and surface sensors 46 described herein, as well as communicate with the actuators 70 and/or PLCs 72 of the surface equipment 74 (e.g., the coiled tubing unit 52, the pump unit 56, the flowback equipment 58, and so forth) and of the downhole equipment 76 (e.g., the BHA 26, the downhole motor 28, the drill bit 30, the downhole well tool 36, and so forth) for the purpose of controlling operation of the coiled tubing system 10, as described in greater detail herein. In certain embodiments, the network interface 68 may also facilitate the surface processing system 42 to communicate data to the cloud storage 50 (or other wired and/or wireless communication network) to, for example, archive the data or to enable external computing systems 78 to access the data and/or to remotely interact with the surface processing system 42.

It should be appreciated that the well control system 60 illustrated in FIG. 2 is only one example of a well control system, and that the well control system 60 may have more or fewer components than shown, may combine additional components not depicted in the embodiment of FIG. 2, and/or the well control system 60 may have a different configuration or arrangement of the components depicted in FIG. 2. In addition, the various components illustrated in FIG. 2 may be implemented in hardware, software, or a combination of both hardware and software, including one or more signal processing and/or application specific integrated circuits. Furthermore, the operations of the well control system 60 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

As described in greater detail herein, the embodiments described herein facilitate the operation of well-related tools. For example, a variety of data (e.g., downhole data and surface data) may be collected to enable optimization of operations of well-related tools such as the downhole well tool 36 illustrated in FIG. 1 by the surface processing system 42 illustrated in FIG. 2 (or other suitable processing systems). In certain embodiments, the data may be provided as advisory data by the surface processing system 42 (or other suitable processing systems). However, in other embodiments, the data may be used to facilitate automation of downhole processes and/or surface processes (i.e., the processes may be automated without human intervention), as described in greater detail herein, by the surface processing system 42 (or other suitable processing system). The embodiments described herein may enhance downhole operations by improving the efficiency and utilization of data to enable performance optimization and improved resource controls.

As described in greater detail herein, in certain embodiments, downhole parameters may be obtained via, for example, downhole sensors 40 while the downhole well tool 36 is disposed within the wellbore 14. In certain embodiments, the downhole parameters may be obtained in substantially real time and sent to the surface processing system 42 via wired or wireless telemetry. In certain embodiments, downhole parameters may be combined with surface parameters by the surface processing system 42. In certain embodiments, the downhole and surface parameters may be processed by the surface processing system 42 during use of the downhole well tool 36 to enable automatic (e.g., without human intervention) optimization with respect to use of the downhole well tool 36 during subsequent stages of operation of the downhole well tool 36.

Non-limiting examples of downhole parameters that may be sensed in substantially real time include, but are not limited to, weight on bit (WOB), torque acting on the downhole well tool 36, downhole pressures, downhole differential pressures, and other desired downhole parameters. In certain embodiments, downhole parameters may be used by the surface processing system 42 in combination with surface parameters, and such surface parameters may include, but are not limited to, pump-related parameters (e.g., pump rate and circulating pressures of the pump unit 56). In certain embodiments, the surface parameters also may include parameters related to fluid returns (e.g., wellhead pressure, return fluid flow rate, choke settings, amount of proppant returned, and other desired surface parameters). In certain embodiments, the surface parameters also may include data from the coiled tubing unit 52 (e.g., surface weight of the coiled tubing string 12, speed of the coiled tubing 20, rate of penetration, and other desired parameters). In certain embodiments, the surface data that may be processed by the surface processing system 42 to optimize performance also may include previously recorded data such as fracturing data (e.g., close-in pressures from each fracturing stage, proppant data, friction data, fluid volume data, and other desired data).

In certain embodiments, use of the downhole data and surface data enables the surface processing system 42 to self-learn (e.g., modeling or simulation using the machine learning or artificial intelligence (AI) based processors, machine learning or AI based algorithms stored in the one or more storage media 66, or a combinations thereof). This real-time modeling by the surface processing system 42, based on the downhole and surface parameters, enables improved downhole operations. Such modeling by the surface processing system 42 also enables the downhole process to be automated and automatically optimized by the surface processing system 42. For instance, the modeling based on the downhole parameters may be used by the surface processing system 42 to predict wear on the downhole motor 28 and/or the drill bit 30, and to advise as to timing of the next trip to the surface for replacement of the downhole motor 28 and/or the drill bit 30.

In certain embodiments, the modeling based on the downhole parameters also enable use of pressures to be used by the surface processing system 42 in characterizing the formation 16. Such real-time downhole parameters also enable use of pressures by the surface processing system 42 for in situ evaluation and advisory of post-fracturing flow back parameters, and for creating an optimum flow back schedule for maximized production of, for example, hydrocarbon fluids from the surrounding formation 16. Data available from a given well may be utilized in designing the next fracturing schedule for the same pad/neighbor wells as well as predictions regarding subsequent wells.

For example, downhole data such as WOB, torque data from a load module associated with the downhole well tool 36, and bottom hole pressures (internal and external to the bottom hole assembly 26/downhole well tool 36) may be processed via the surface processing system 42. The processed data may then be utilized by the surface processing system 42 to control the injector head 54 to generate, for example, a faster and more controlled rate of penetration (ROP). Additionally, the processed data may be updated by the surface processing system 42 as the downhole well tool 36 is moved to different positions along the wellbore 14 to help optimize operations. The processed data also enables automation of the downhole process through automated controls over the injector head 54 via control instructions provided by the surface processing system 42.

In certain embodiments, data from downhole may be combined by the surface processing system 42 with surface data received from injector head 54 and/or other measured or stored surface data. By way of example, surface data may include hanging weight of the coiled tubing string 12, speed of the coiled tubing 20, wellhead pressure, choke and flow back pressures, return pump rates, circulating pressures (e.g., circulating pressures from the manifold of a coiled tubing reel in the coiled tubing unit 52), and pump rates. The surface data may be combined with the downhole data by the surface processing system 42 with in real time to provide an automated system that self-controls the injector head 54. For example, the injector head 54 may be automatically controlled (e.g., without human intervention) to optimize ROP under direction from the surface processing system 42.

In certain embodiments, data from drilling parameters (e.g., surveys and pressures) as well as fracturing parameters (e.g., volumes and pressures) may be combined with real-time data obtained from sensors 40, 46. The combined data may be used by the surface processing system 42 in a manner that aids in machine learning and/or artificial intelligence to automate subsequent jobs in the same well and/or for neighboring wells. The accurate combination of data and the updating of that data in real time helps the surface processing system 42 improve the automatic performance of subsequent tasks.

In certain embodiments, depending on the type of operation downhole, the surface processing system 42 may be programmed with a variety of algorithms and/or modeling techniques to achieve desired results. For example, the downhole data and surface data may be combined and at least some of the data may be updated in real time by the surface processing system 42. This updated data may be processed by the surface processing system 42 via suitable algorithms to enable automation and to improve the performance of, for example, downhole well tool 36. By way of example, the data may be processed and used by the surface processing system 42 for preventing motor stalls. In certain embodiments, downhole parameters such as forces, torque, and pressure differentials may be combined by the surface processing system 42 to enable prediction of a next stall of the downhole motor 28 and/or to give a warning to a supervisor. In such embodiments, the surface processing system 42 may be programmed to make self-adjustments (e.g., automatically, without human intervention) to, for example, speed of the injector head 54 and/or pump pressures to prevent the stall, and to ensure efficient continuous operation.

In addition, in certain embodiments, the data and the ongoing collection of data may be used by the surface processing system 42 to monitor various aspects of the performance of downhole motor 28. For example, motor wear may be detected by monitoring the effective torque of the downhole motor 28 based on data obtained regarding pump rates, pressure differentials, and actual torque measurements of the downhole well tool 36. Various algorithms may be used by the surface processing system 42 to help a supervisor on site to predict, for example, how many more hours the downhole motor 28 may be run efficiently. This data, and the appropriate processing of the data, may be used by the surface processing system 42 to make automatic decisions or to provide indications to a supervisor as to when to pull the coiled tubing string 12 to the surface to replace the downhole motor 28, the drill bit 30, or both, while avoiding unnecessary trips to the surface.

In certain embodiments, downhole data and surface data also may be processed via the surface processing system 42 to predict a time when the coiled tubing string 12 may become stuck. The ability to predict when the coiled tubing string 12 may become stuck helps avoid unnecessary short trips and, thus, improves coiled tubing pipe longevity. In certain embodiments, downhole parameters such as forces, torque, and pressure differentials in combination with surface parameters such as weight of the coiled tubing 20, speed of the coiled tubing 20, pump rate, and circulating pressure may be processed via the surface processing system 42 to provide predictions as to the time when the coiled tubing 20 will become stuck.

In certain embodiments, the surface processing system 42 may be designed to provide warnings to a supervisor and/or to self-adjust (e.g., automatically, without human intervention) either the speed of the injector head 54, the pump pressures and rates of the pump unit 56, or a combination of both, so as to prevent the coiled tubing 20 from getting stuck based on the predictions described herein. By way of example, the warnings or other information may be output to a display of the surface processing system 42 to enable an operator to make better, more informed decisions regarding downhole or surface processes related to operation of the downhole well tool 36. In certain embodiments, the speed of the injector head 54 may be controlled via the surface processing system 42 by controlling the slack-off force from the surface. In general, the ability to predict and prevent the coiled tubing 20 from becoming stuck substantially improves the overall efficiency, and helps avoid unnecessary short trips if the probability of the coiled tubing 20 getting stuck is minimal. Accordingly, the downhole data and surface data may be used by the surface processing system 42 to provide advisory information and/or automation of surface processes, such as pumping processes or other processes.

Figure 3:
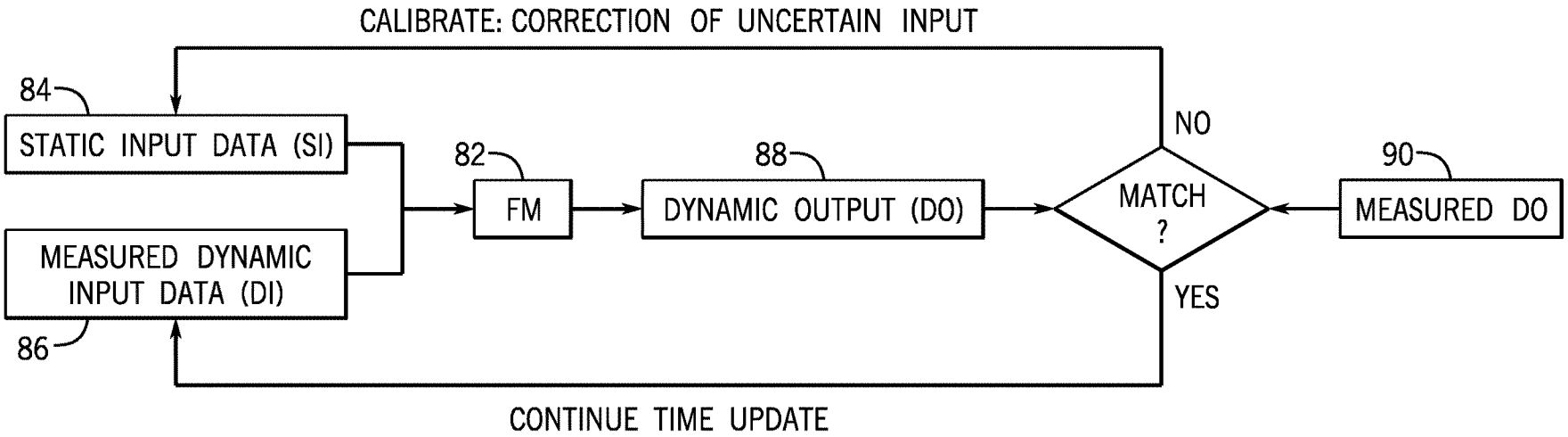
FIG. 3 illustrates a process for utilizing a Flow Model (FM), in accordance with embodiments of the present disclosure.

The embodiments described herein generally relate to systems and methods for utilizing the FM described herein, which includes a set of mathematical equations that describe the physical phenomena occurring in the wellbore 14 during the CTCO. In certain embodiments, such equations may be solved by computer algorithms to provide predictions and/or means to estimate quantities that can or cannot be measured. FIG. 3 illustrates a process 80 for utilizing the FM 82 described herein. In certain embodiments, to make predictions with the FM 82, certain input data are required including, but not limited to:

- Static Input data (SI) 84
  - hole surveys of the wellbore 14
  - completion diagram
  - fluid properties
  - reservoir properties
  - dimensions of the coiled tubing 20
- Dynamic Input (DI) 86
  - pump rates for all injected fluids
  - wellhead pressure
  - movement of the coiled tubing 20

Many input data to the FM 82 have a certain amount of uncertainty. For example, reservoir properties are often not known with sufficient accuracy for the FM 82 to make deterministic accurate predictions. These uncertainties may be reduced in substantially real time by comparing the simulated DOs 88 and the measured DOs 90 and by adjusting the uncertain parameters to minimize the difference between the two DOs 88, 90. This process of minimization is called calibration. The purpose of the calibration is generally to reduce uncertainty in the predictions of the FM 82 and to better understand some of the unknown aspects of the downhole environment (e.g., some of the reservoir characteristics or the downhole dynamic flow behavior).

Example DOs 88, 90 that the FM 82 may produce include, but are not limited to:

- pressure and temperature profiles and their evolution everywhere along the coiled tubing 20 and along the wellbore 14
- fluid velocity profiles and evolution inside the coiled tubing 20, along the annulus and below the end fluid properties of the coiled tubing 20
- flow rates between the wellbore 14 and reservoir dimensions of the coiled tubing 20
- fluids volume fractions in the coiled tubing 20, the annulus, and below the end of the coiled tubing 20
- solids volume fractions in the annulus and below the end of the coiled tubing 20

From the above, other quantities of interest may be derived, such as surface return rates of solids or leak-off/inflow to/from the formation 16.

Determination of the Depth of the Solids Origin (DSO)

Evidence that solids are present in the wellbore 14 may be determined by the following events:

- Solids are detected in the produced fluids at the surface. In certain embodiments, this can be visual observation from an operator or detected by surface sensors 46.
- An increase of wellbore fluid apparent density above the physical value that the involved fluids' density may take. In certain embodiments, such wellbore fluid apparent density may be computed from the readings of at least two pressure sensors 40 at different depths along the wellbore 14.
- A decrease of the weight of the coiled tubing 20 caused by the increased wellbore fluid apparent density and resulting in an increase in buoyancy of the coiled tubing 20 (e.g., Archimedes' principle). In certain embodiments, this weight decrease may be detected by surface sensors 46 (e.g., by a load cell at the surface).
- A sudden drop in the weight of the coiled tubing 20 due to the coiled tubing 20 reaching a wellbore obstacle formed by the solids fill.
- A reflection wave generated by the emission of acoustic or pressure waves that is detected by acoustic or pressure sensors 40 on the wellbore hardware or on the coiled tubing 20.

Figure 4:
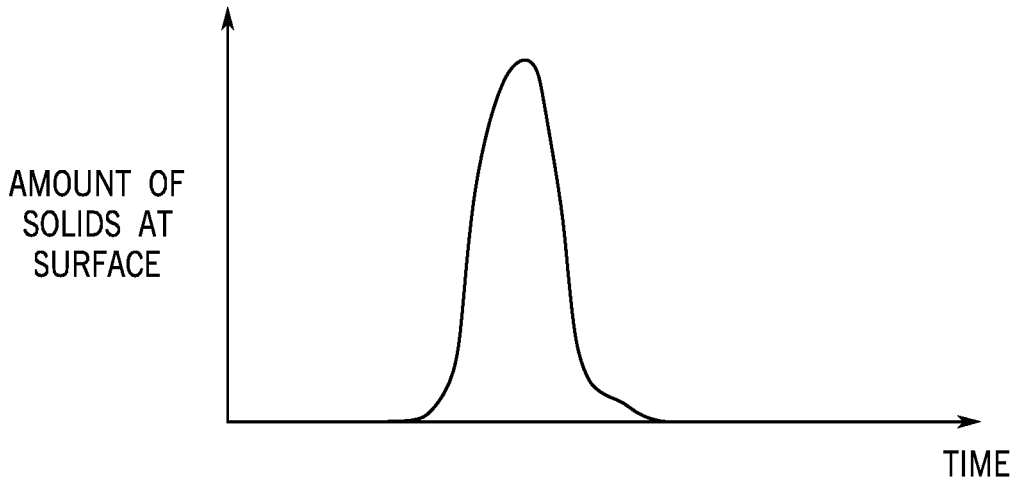
FIG. 4 is an example graph of a Monitored Signature (MS): solids production rate at the surface versus time, in accordance with embodiments of the present disclosure.
Figure 5:
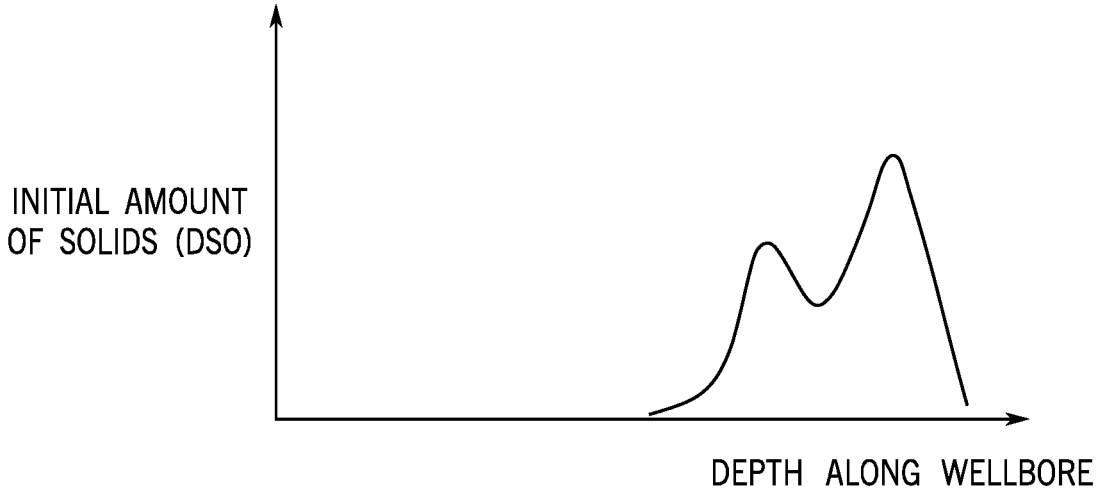
FIG. 5 is an example graph of initial distribution of solids in a wellbore, in accordance with embodiments of the present disclosure.

Whatever method is used, the "signature" may be called the evolution in time of the parameter that the method is measuring and that indicates the presence of the solids. The signature of the method that is being used is called the Monitored Signature (MS). To determine the DSO, once evidence of their presence has been detected by one of the above methods, that is, when the MS is observed, the following real-time DOs may be required:

- If solids are observed at the surface:
  - the measured amount of solids produced at the surface, as a function of time
  - the nature of the solids, such as measured density and particle size
- If another detected method is used:
  - the MS (e.g., the evolution in time of the wellbore fluid apparent density)
- The measured production rate of each fluid at the surface, as a function of time In certain embodiments, the two steps of the method may include: (1) the real-time continuous calibration of the FM 82 using the time-history of the measured fluid production rates at the surface to improve the accuracy of the flow velocities along the wellbore 14 as predicted by the FM 82, and (2) the use of the calibrated FM 82 to interpret the history of solids production observed at the surface or the MS of the other method being used. The purpose of the interpretation is generally to determine the DSO that is consistent with the MS. An example using solids production rates at the surface as the MS is illustrated in FIG. 4. An example of the DSO is illustrated in FIG. 5.

First Method

A first method applies to situations where the presence of solids in the wellbore 14 does not affect the wellbore hydrodynamics significantly. Examples include solids that can be easily suspended, such as fine particles and shallow deposition beds. When solid particles do not affect the wellbore hydrodynamics significantly, the wellbore flow velocities produced by a calibrated FM 82 may be used directly to predict the flow of the solid particles, even if the FM 82 does not simulate the transport of solids during calibration. In certain embodiments, the wellbore flow velocities are computed up to the moment the solids are observed at the surface (i.e., during calibration of the FM 82). Then, these stored wellbore flow velocities (i.e., that do not require re-computation) are used during the iterative process of looking for the actual DSO, as described in greater detail herein. At this point, during this iterative process, the FM 82 is not used; only the wellbore flow velocities that were produced during calibration of the FM 82 are used.

Figure 6:
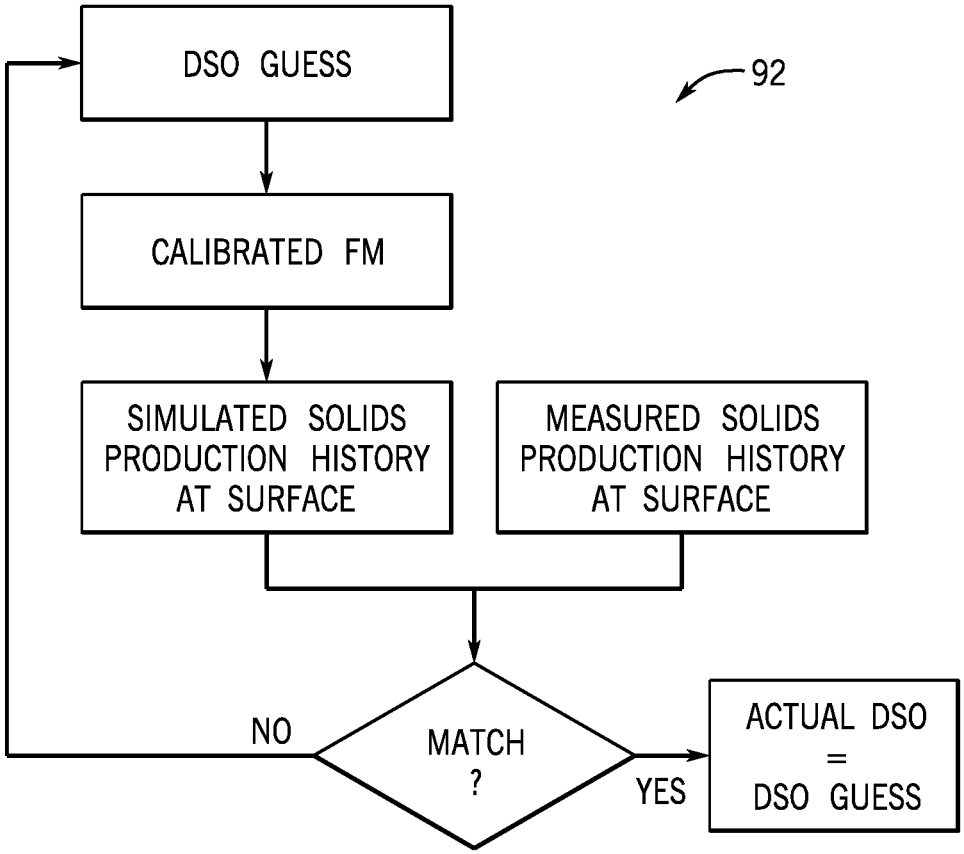
FIG. 6 illustrates a workflow of a first method when the MS is solids production at the surface, in accordance with embodiments of the present disclosure.
Figure 7:
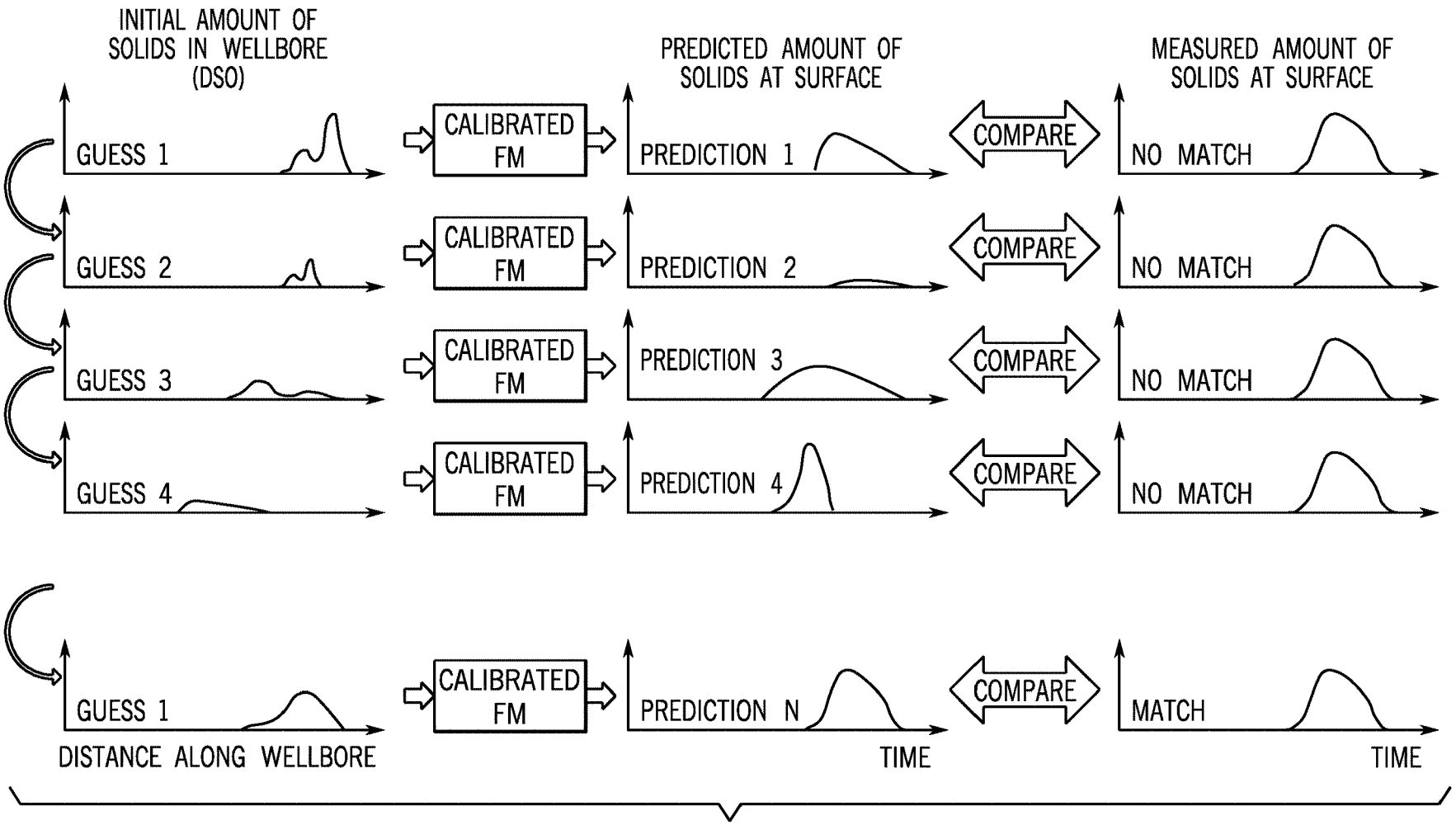
FIG. 7 illustrates results of the workflow of FIG. 6 as a series of iterative runs until an actual DSO is a match to a DSO guess when the MS is solids production at the surface, in accordance with embodiments of the present disclosure.

FIG. 6 illustrates a workflow 92 of the first method when the MS is the solids production at the surface, and FIG. 7 illustrates the results of the workflow 92 of FIG. 6 as a series of iterative runs until the actual DSO is a match to the DSO guess when the MS is the solids production at the surface 24. In particular, as illustrated in FIG. 6, the DSO guess may be used to calibrate the FM 82, which is in turn used to determine simulated solids production history at the surface 24, which may be compared to the measured solids production history at the surface 24 to see if there is a match (e.g., if a difference between the simulated solids production history at the surface 24 and the measured solids production history at the surface 24 is within a predetermined threshold). If there is a match, then the actual DSO may be considered to be equal to the DSO guess. However, if there is not a match, then the DSO may be adjusted, and another pass through the workflow 92 may be performed. Indeed, the workflow 92 may be iteratively performed until there is a match.

As illustrated in FIG. 7, the results consist of guessed depths of origin and distribution of deposition to predict the amount of solids at surface with the calibrated FM 82 and then comparing with the measured amount of solids at surface, until a match is reached, as illustrated at the bottom of FIG. 7. As used herein, the term "match" may be used to define when two data series (e.g., such as those illustrated in FIGS. 3, 4, 7, 9, and 11) include a plurality of data values that having corresponding data values in the other time series that cumulatively differ by less than a predetermined amount.

To solve the interpretation part of the first method, several new runs of the calibrated FM 82 may be performed until the MS is observed on the FM run. Each run uses a version of the FM 82 that has been calibrated by the process illustrated in FIG. 3. In addition, each run considers a different guessed DSO and simulates the CTCO from start to the end of the period during which the MS is observed. The simulated MS may then be compared with the actual MS. New runs with DSO guesses may be created iteratively until a match is observed. When the simulated MS matches the measured one, the corresponding guessed DSO is assumed to be the sought DSO. During this first method, and until the MS is observed, only one instance of the FM 82 may be used and calibrated. Once the MS is observed, this instance of the FM 82 may be re-used for each guess of the DSO until a match is found. In addition, once the actual DSO is determined, one or more operational parameters of the coiled tubing system 10 may be adjusted to reduce an amount of the solids at the DSO within the wellbore 14.

Figure 8:
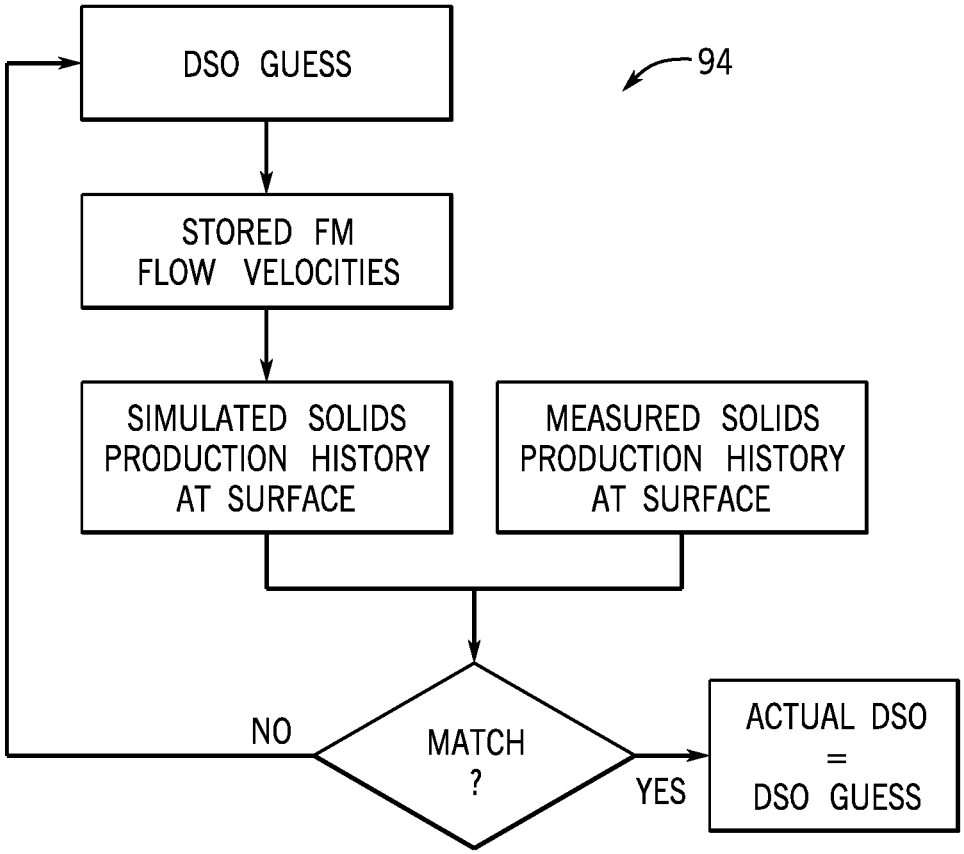
FIG. 8 illustrates another workflow of the first method when the MS is solids production at the surface, in accordance with embodiments of the present disclosure.
Figure 9:
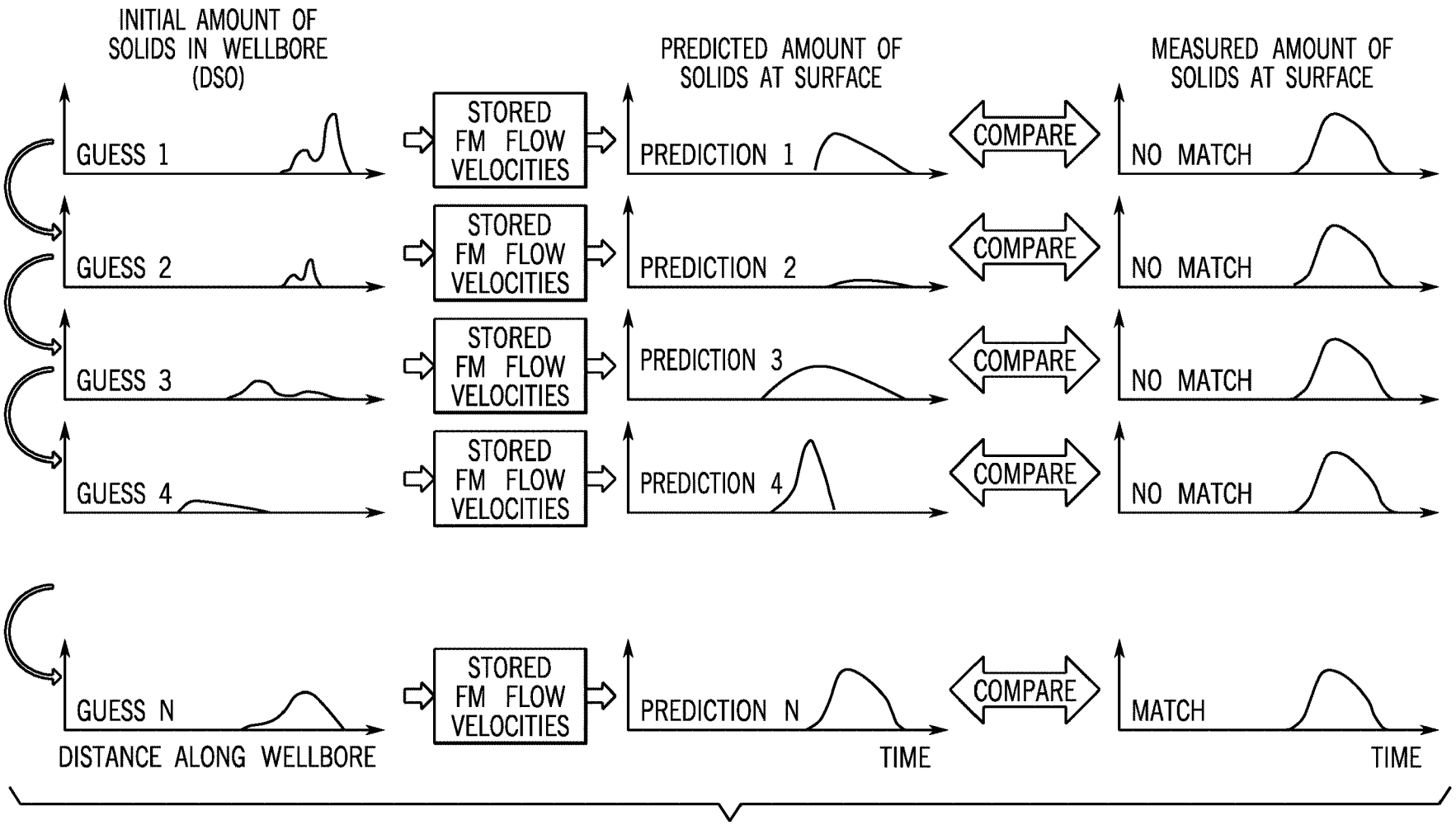
FIG. 9 illustrates results of the workflow of FIG. 8 as a series of iterative runs until an actual DSO is a match to a DSO guess when the MS is solids production at the surface, in accordance with embodiments of the present disclosure.

FIG. 8 illustrates another workflow 94 of the first method when the MS is the solids production at the surface, which is a variation of the workflow 92 of FIG. 6, and FIG. 9 illustrates the results of the workflow 94 of FIG. 8 as a series of iterative runs until the actual DSO is a match to the DSO guess when the MS is the solids production at the surface 24. In particular, as illustrated in FIG. 8, the DSO guess may be used to determine FM flow velocities, which in turn may be used to determine simulated solids production history at the surface 24, which may be compared to the measured solids production history at the surface 24 to see if there is a match (e.g., if a difference between the simulated solids production history at the surface 24 and the measured solids production history at the surface 24 is within a predetermined threshold). If there is a match, then the actual DSO may be considered to be equal to the DSO guess. However, if there is not a match, then the DSO may be adjusted, and another pass through the workflow 94 may be performed. Indeed, the workflow 94 may be iteratively performed until there is a match.

As illustrated in FIG. 9, the results consist of guessed depths of origin and distribution of deposition to predict the amount of solids at the surface with the stored wellbore flow velocities previously computed during calibration of the FM 82 and then comparing with the measured amount of solids at the surface, until a match is reached, as illustrated at the bottom of FIG. 9. To simulate the transport of the solid particles during the CTCO, it is necessary and sufficient to compute the flow velocities along the wellbore 14. This variation of the first method consists of storing in memory the history and distribution of the flow velocities along the wellbore 14, as simulated with the calibrated FM 82, from the start of the CTCO to the end of the MS. Then, this stored data may be re-used directly to compute the MS, for each guess without having to re-run the calibrated FM 82. In addition, once the actual DSO is determined, one or more operational parameters of the coiled tubing system 10 may be adjusted to reduce an amount of the solids at the DSO within the wellbore 14.

The speed of convergence of the iterative method consisting of adjusting the guessed DO until the simulated and observed MS match may be improved compared to a method picking only a random guessed DO at each iteration. In particular, the following considerations may be used:

- If the predicted MS occurs earlier (or later) than the observed MS, the DO may be set to larger (or smaller) values at the next iteration.
- Depths where solid particles are physically more likely to settle may be investigated first. For instance, in general, particles are more likely to settle along sections of the well with relatively low inclination angles.
- Various optimization methods may be used to find the correct DO faster. Such methods include deterministic and stochastic methods.
- Use of knowledge of previous wellbore intervention that may have an implication with the formation 16 of the solids fill. For instance, proppant flowback after hydraulically fracturing the formation 16 with proppant at a known depth. Use of knowledge of reservoir zones which are historically known to produce solids.

Second Method

Figure 10:
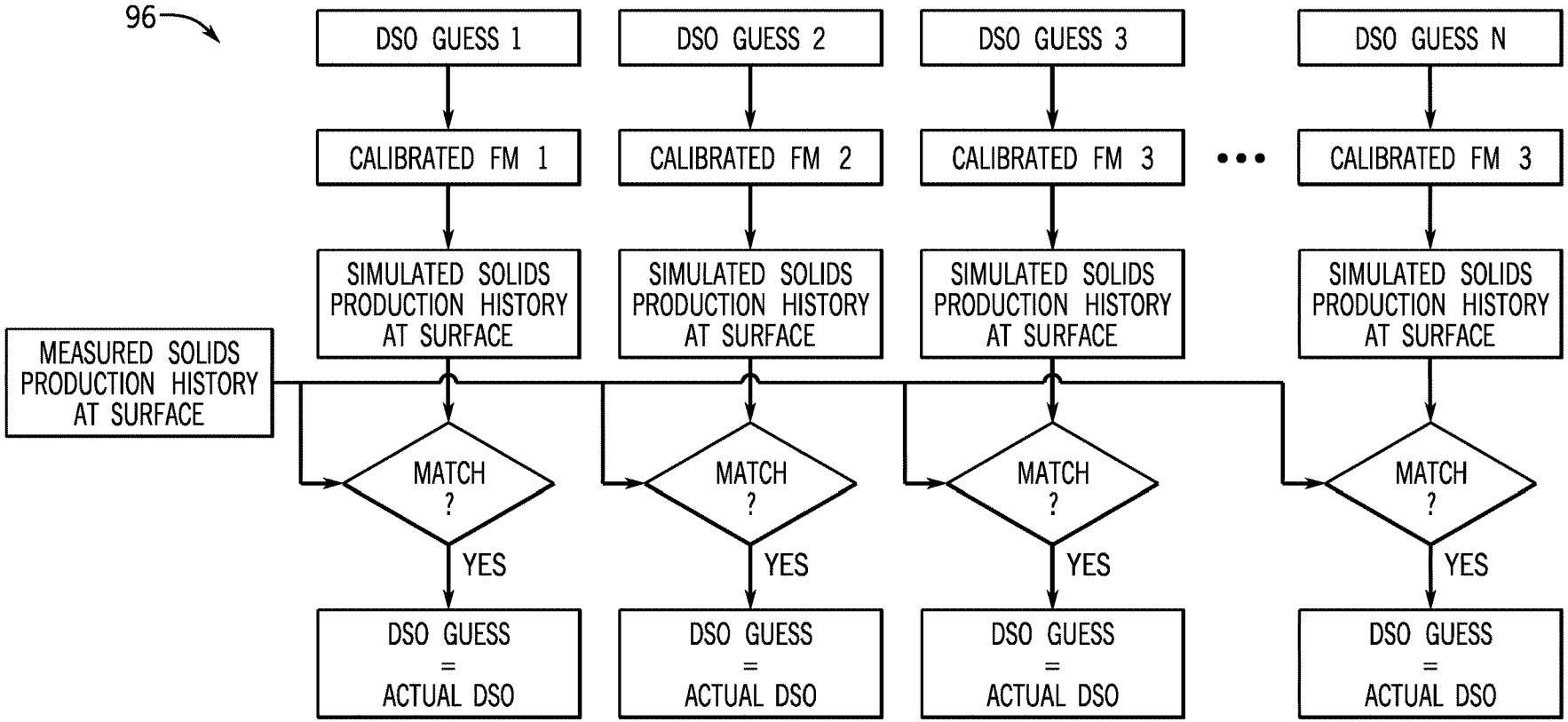
FIG. 10 illustrates a workflow of a second method when the MS is solids production at the surface, in accordance with embodiments of the present disclosure.
Figure 11:
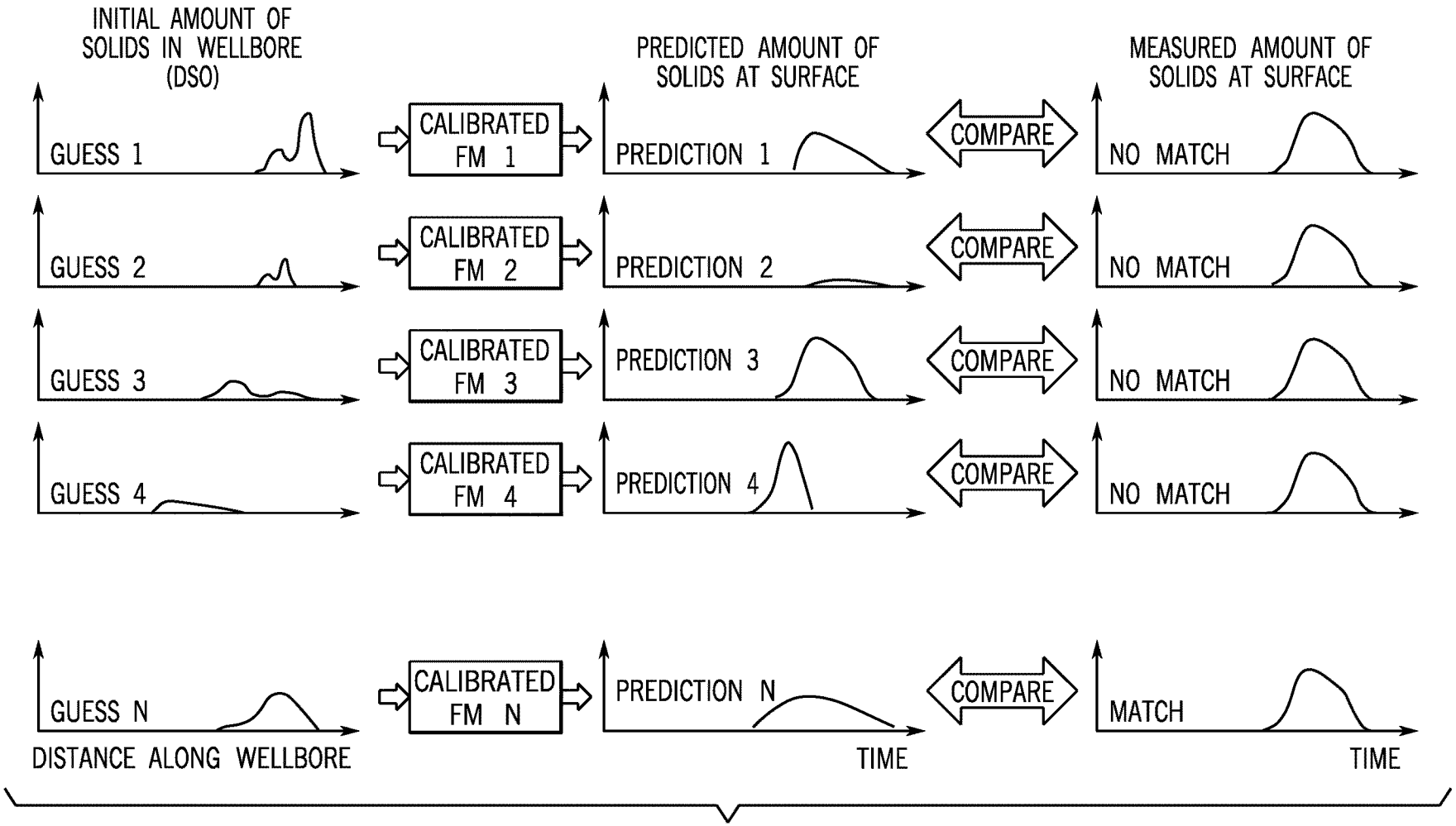
FIG. 11 illustrates results of the workflow of FIG. 10 as a series of iterative runs until an actual DSO is a match to a DSO guess when the MS is solids production at the surface, in accordance with embodiments of the present disclosure.

A second method applies to all situations, but is more computationally intensive than the first method. FIG. 10 illustrates a workflow 96 of the second method when the MS is the solids production at the surface, and FIG. 11 illustrates the results of the workflow 96 as a series of iterative runs until the actual DSO is a match to the DSO guess when the MS is the solids production at the surface. As illustrated in FIG. 11, the results consist of several instances of the calibrated FMs 82, each with a different depth of origin, to predict in parallel the amount of solids at the surface and then comparing each prediction with the measured amount of solids at the surface, as illustrated at the bottom of FIG. 11. To solve the interpretation part of the second method, several instances of the FM 82 are performed in parallel from the onset of the CTCO. Each instance differs from the next by its assumed DSO. Each instance of the FM 82 remains calibrated independently according to the process described with respect to FIG. 3. When the MS is observed, it is compared with the MS predicted by each instance of the calibrated FM 82. The sought DSO is that of the FM instance which provides the MS that matches the closest the measured one. During the second method and until the MS is observed, multiple instances of the FM 82 may be used and calibrated in parallel, each with a different guess of the depth of origin. Once the MS is detected, only the instance of the FM 82 that provides a match of the solids surface production history may be kept.

In addition, in certain embodiments, once the actual DSO is determined, one or more operational parameters of the coiled tubing system 10 may be adjusted (e.g., automatically adjusted, in certain embodiments) to reduce an amount of the solids at the DSO within the wellbore 14, to minimize a volume of the pumped fluids required to reduce the amount of the solids at the DSO within the wellbore 14 and/or to minimize the time taken to reduce the amount of the solids at the DSO within the wellbore 14.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A method for wellbore cleanout using coiled tubing, the method comprising:

(a) generating a plurality of depth of solids origin (DSO) guesses, each DSO guess representing a respective estimated initial depth location of an accumulation of solids below a surface at an initial bed position in a wellbore traversing a hydrocarbon-bearing formation, the accumulation of solids comprising an accumulation of material remaining in the wellbore from a previous wellbore operation;

(b) using a plurality of calibrated flow models (FMs) running in parallel to each predict a respective amount of solids at a surface location of the wellbore based at least in part on the DSO guess, each FM model including a different DSO guess among the plurality of DSO guesses;

(c) for each of the plurality of FMs, comparing the predicted amount of the solids at the surface location of the wellbore to a measured amount of solids at the surface location of the wellbore;

(d) selecting an FM among the plurality of FMs outputting a predicted amount of the solids that best matches the measured amount of solids;

(e) determining that the DSO guess of the selected FM is equal to an actual DSO within the wellbore when the predicted amount of the solids at the surface location of the wellbore matches the measured amount of solids at the surface location of the wellbore;

(f) setting operational parameters using the determination from step (e), the operational parameters comprising one or more of coiled tubing movement, pump rates, or fluid selection; and (g) injecting fluids via a coiled tubing system to flush the accumulation of solids below the surface to the surface location using the operational parameters set in step (e), starting at the estimated initial depth location by injecting fluids into the coiled tubing system such that one or more operational parameters of the coiled tubing system are set based on the actual DSO when the DSO guess of the selected FM is determined to be equal to the actual DSO.

2. The method of claim 1, further comprising adjusting the one or more operational parameters of the coiled tubing system to reduce an amount of the solids at the actual DSO within the wellbore.

3. The method of claim 1, further comprising adjusting the one or more operational parameters of the coiled tubing system to minimize a volume of pumped fluids required to reduce an amount of the solids at the actual DSO within the wellbore.

4. The method of claim 1, further comprising adjusting the one or more operational parameters of the coiled tubing system to minimize a time taken to reduce an amount of the solids at the actual DSO within the wellbore.

5. The method of claim 1, further comprising adjusting the one or more operational parameters of the coiled tubing system to:

reduce an amount of the solids at the actual DSO within the wellbore;

minimize a volume of pumped fluids required to reduce an amount of the solids at the actual DSO within the wellbore; and minimize a time taken to reduce an amount of the solids at the actual DSO within the wellbore.

6. The method of claim 1, further comprising iteratively repeating steps (a)-(e) while adjusting the DSO guess until the predicted amount of the solids at the surface location of the wellbore matches the measured amount of solids at the surface location of the wellbore.

7. The method of claim 6, further comprising re-calibrating the FM between iterations of repeating steps (a)-(e).

8. The method of claim 1, further comprising calibrating each FM prior to step (a) by:

(i) inputting static input data and measured dynamic input data into the FM;

(ii) using the FM to generate dynamic output data based at least in part on the static input data and measured dynamic input data;

(iii) comparing the dynamic output data to measured dynamic output data; and (iv) determining that the FM is calibrated when the dynamic output data matches the measured dynamic output data.

9. The method of claim 8, further comprising iteratively repeating steps (i)-(iv) while adjusting the static input data and measured dynamic input data relating to at least one input until the dynamic output data matches the measured dynamic output data.

10. The method of claim 1, wherein:

each FM comprises wellbore flow velocities along the wellbore computed during calibration of the FM prior to step (a); and the wellbore flow velocities are used to predict the amount of solids at the surface location of the wellbore.

11. The method of claim 1, wherein:

the DSO guess is generated based on one or more sensed downhole parameters of the wellbore; and the one or more sensed downhole parameters of the wellbore comprise one or more of: a weight on bit (WOB), a torque acting on a downhole well tool, a downhole pressure, or a downhole differential pressure.

12. The method of claim 11, wherein:

the DSO guess is generated further based on one or more sensed surface parameters at the surface location in combination with the one or more sensed downhole parameters; and the one or more sensed surface parameters comprise one or more of: a pump-related parameter, a pump rate of a pump unit, a circulating pressure of the pump unit, a parameter related to fluid returns, wellhead pressure, a return fluid flow rate, a choke setting, an amount of proppant returned, data from coiled tubing of the coiled tubing system, a surface weight of the coiled tubing, a speed of the coiled tubing, or a rate of penetration of the coiled tubing.

13. The method of claim 1, wherein the generating the DSO guess for each of the plurality of FMs comprises using changes in wellbore fluid apparent density, tubing weight anomalies, or acoustic or pressure wave reflections.

14. The method of claim 1, wherein the generating the DSO guess for each of the plurality of FMs comprises iteratively matching simulated solids production obtained using stored flow velocities from FM calibration to measured surface solids production.

15. A processing and control system for wellbore cleanout using coiled tubing, the system configured to:

(a) generate a plurality of depth of solids origin (DSO) guesses, each DSO guess representing a respective estimated initial depth location of an accumulation of solids below a surface at an initial bed position in a wellbore traversing a hydrocarbon-bearing formation, the accumulation of solids comprising an accumulation of material remaining in the wellbore from a previous wellbore operation;

(b) use a plurality of calibrated flow models (FMs) running in parallel to each predict a respective amount of solids at a surface location of the wellbore based at least in part on the DSO guess, each FM model including a different DSO guess among the plurality of DSO guesses;

(c) for each of the plurality of FMs, compare the predicted amount of the solids at the surface location of the wellbore to a measured amount of solids at the surface location of the wellbore;

(d) select an FM among the plurality of FMs outputting a predicted amount of the solids that best matches the measured amount of solids;

(e) determine that the DSO guess of the selected FM is equal to an actual DSO within the wellbore when the predicted amount of the solids at the surface location of the wellbore matches the measured amount of solids at the surface location of the wellbore;

(f) set operational parameters using the determination from step (e), the operational parameters comprising one or more of coiled tubing movement, pump rates, or fluid selection; and (g) inject fluids via a coiled tubing system to flush the accumulation of solids below the surface to the surface location using the operational parameters set in step (e), starting at the estimated initial depth location by injecting fluids into the coiled tubing system such that one or more operational parameters of the coiled tubing system are set based on the actual DSO when the DSO guess of the selected FM is determined to be equal to the actual DSO.

16. The processing and control system of claim 15, wherein the processing and control system is configured to adjust the one or more operational parameters of the coiled tubing system to reduce an amount of the solids at the actual DSO within the wellbore.

17. The processing and control system of claim 15, wherein the processing and control system is configured to adjust the one or more operational parameters of the coiled tubing system to minimize a volume of pumped fluids required to reduce an amount of the solids at the actual DSO within the wellbore.

18. The processing and control system of claim 15, wherein the processing and control system is configured to adjust the one or more operational parameters of the coiled tubing system to minimize a time taken to reduce an amount of the solids at the actual DSO within the wellbore.

19. The processing and control system of claim 15, wherein the processing and control system is further configured to adjust one or more operational parameters of the coiled tubing system to:

reduce an amount of the solids at the actual DSO within the wellbore;

minimize a volume of pumped fluids required to reduce an amount of the solids at the actual DSO within the wellbore; and minimize a time taken to reduce an amount of the solids at the actual DSO within the wellbore.

20. The processing and control system of claim 15, wherein the processing and control system is further configured to iteratively repeat steps (a)-(e) while adjusting the DSO guess until the predicted amount of the solids at the surface location of the wellbore matches the measured amount of solids at the surface location of the wellbore.

21. The processing and control system of claim 20, wherein the processing and control system is further configured to re-calibrate each FM between iterations of repeating steps (a)-(e).

22. The processing and control system of claim 15, wherein the processing and control system is further configured to calibrate each FM prior to step (a) by:

(i) inputting static input data and measured dynamic input data into the FM;

(ii) using the FM to generate dynamic output data based at least in part on the static input data and measured dynamic input data;

(iii) comparing the dynamic output data to measured dynamic output data; and (iv) determining that the FM is calibrated when the dynamic output data matches the measured dynamic output data.

23. The processing and control system of claim 22, wherein the processing and control system is further configured to iteratively repeat steps (i)-(iv) while adjusting the static input data and measured dynamic input data relating to at least one input until the dynamic output data matches the measured dynamic output data.

24. The processing and control system of claim 15, wherein:

each FM comprises wellbore flow velocities along the wellbore computed during calibration of the FM prior to step (a); and the wellbore flow velocities are used to predict the amount of solids at the surface location of the wellbore.

* * * * *